US005209451A

United States Patent [19]

Vierling

[11] Patent Number: 5,209,451

[45] Date of Patent: May 11, 1993

[54] SELF-LOCKING PEG BOARD HOOK

[76] Inventor: Frank R. Vierling, 37 Jordan La., Raymond, Me. 04071

[21] Appl. No.: 754,635

[22] Filed: Sep. 4, 1991

[51] Int. Cl.[5] ..... F16M 13/00

[52] U.S. Cl. ..... 248/551; 248/222.1

[58] Field of Search ..... 248/222.1, 220.4, 221.1, 248/221.2, 220.3, 551

[56] References Cited

U.S. PATENT DOCUMENTS

| | | | |
|---|---|---|---|
| 3,037,733 | 6/1962 | Roman | 182/222.1 X |
| 3,091,423 | 5/1963 | Butterworth | 248/221.2 |
| 3,193,225 | 7/1965 | Terlinde | 182/221.2 |
| 4,143,845 | 3/1979 | Harris | 248/222.1 X |

*Primary Examiner*—Alvin C. Chin-Shue
*Attorney, Agent, or Firm*—Leon Gilden

[57] ABSTRACT

A peg board hook is arranged with a central body leg, with the central body leg including a hook member mounted at a lower end thereof, with an alignment leg directed rearwardly and orthogonally relative to the central body leg. The central body leg mounts at its upper terminal end a torroidal head to rotatably mount a lock leg thereto. A modification of the invention includes an audible alarm member positioned relative to the hook projection defining a switch gap, whereupon passing of a typical metallic tool within the switch gap effects closure of a thusly defined switch to effect an audible alarm indicating removal of the tool.

2 Claims, 4 Drawing Sheets

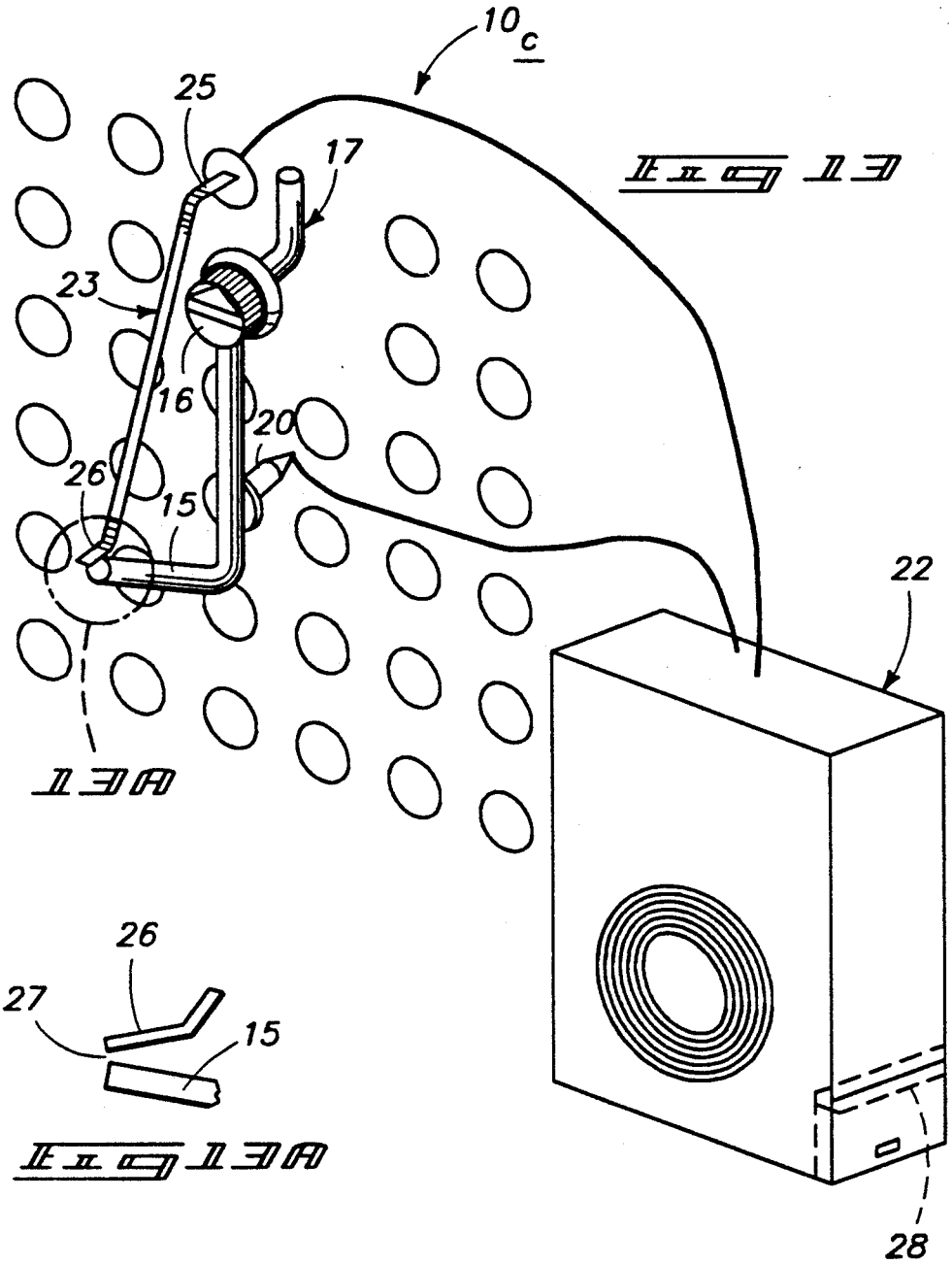
Fig 13
Fig 13A
Fig 13A
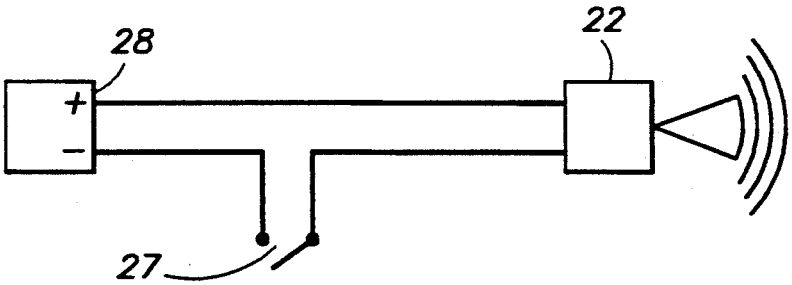
Fig 14

SELF-LOCKING PEG BOARD HOOK

BACKGROUND OF THE INVENTION

1. Field of the Invention

The field of invention relates to peg board hook structure, and more particularly pertains to a new and improved self-locking peg board hook wherein the same is arranged for the selective latching and delatching of a hook structure relative to an associated peg board.

2. Description of the Prior Art

Peg boards of various types are utilized to support various hook structures thereon. Typically, in the use of such hook structures, they are frequently withdrawn from the peg board upon manipulation of various tools and the like positioned upon the hooks. The prior art has utilized various hook organizations for mounting to associated peg boards and such structure is exemplified in U.S. Pat. No. 4,941,632 to Couls, et al. wherein a peg board utilizes a retaining clip mounted to the peg board, wherein the clip is arranged with a spring latch to maintain the peg board hook relative to the associated peg board.

U.S. Pat. No. 4,923,161 to Fahringer sets forth a coupling hook arranged for aligning a peg hook structure relative to an associated peg board.

U.S. Pat. No. 4,928,912 to Florek sets forth a peg board hanger anchor structure, wherein the anchor structure sets forth a generally "W" shaped clip to mount and secure a peg board to an associated hook.

As such, it may be appreciated that there continues to be a need for a new and improved self-locking peg board hook as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of peg hook apparatus now present in the prior art, the present invention provides a self-locking peg board hook wherein the same is arranged to provide for a rotary hook member mounted to an upper terminal end of a peg board hook to provide selective latching of the peg board hook relative to an associated peg board. As such, the general purpose of the present invention, which will be described subsequently in greater detail, is to provide a new and improved self-locking peg board hook which has all the advantages of the prior art peg board hook structure and none of the disadvantages.

To attain this, the present invention provides a peg board hook arranged with a central body leg, with the central body leg including a hook member mounted at a lower end thereof, with an alignment leg directed rearwardly and orthogonally relative to the central body leg. The central body leg mounts at its upper terminal end a torroidal head to rotatably mount a lock leg thereto. A modification of the invention includes an audible alarm member positioned relative to the hook projection defining a switch gap, whereupon passing of a typical metallic tool within the switch gap effects closure of a thusly defined switch to effect an audible alarm indicating removal of the tool.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved self-locking peg board hook which has all the advantages of the prior art peg board hook apparatus and none of the disadvantages.

It is another object of the present invention to provide a new and improved self-locking peg board hook which may be easily and efficiently manufactured and marketed.

It is a further object of the present invention to provide a new and improved self-locking peg board hook which is of a durable and reliable construction.

An even further object of the present invention is to provide a new and improved self-locking peg board hook which is susceptible of a low cost of manufacture with regard to both materials and labor, and which accordingly is then susceptible of low prices of sale to the consuming public, thereby making such self-locking peg board hooks economically available to the buying public.

Still yet another object of the present invention is to provide a new and improved self-locking peg board hook which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 13 is an isometric illustration of a modification of the invention.

FIG. 13*a* is an orthographic view of section 13*a*, as set forth in FIG. 13.

FIG. 14 is a schematic illustration of a typical electrical circuit utilized by the invention as set forth in FIG. 13.

DESCRIPTION OF THE PREFERRED EMBODIMENT

Figure 1:
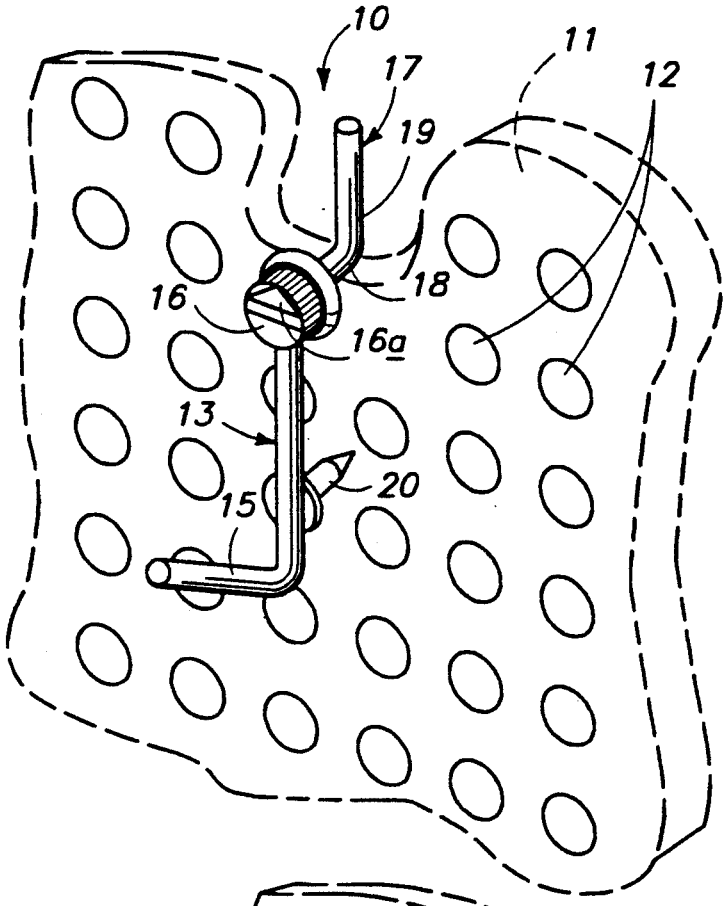
FIG. 1 is an isometric illustration of the instant invention.
Figure 2:
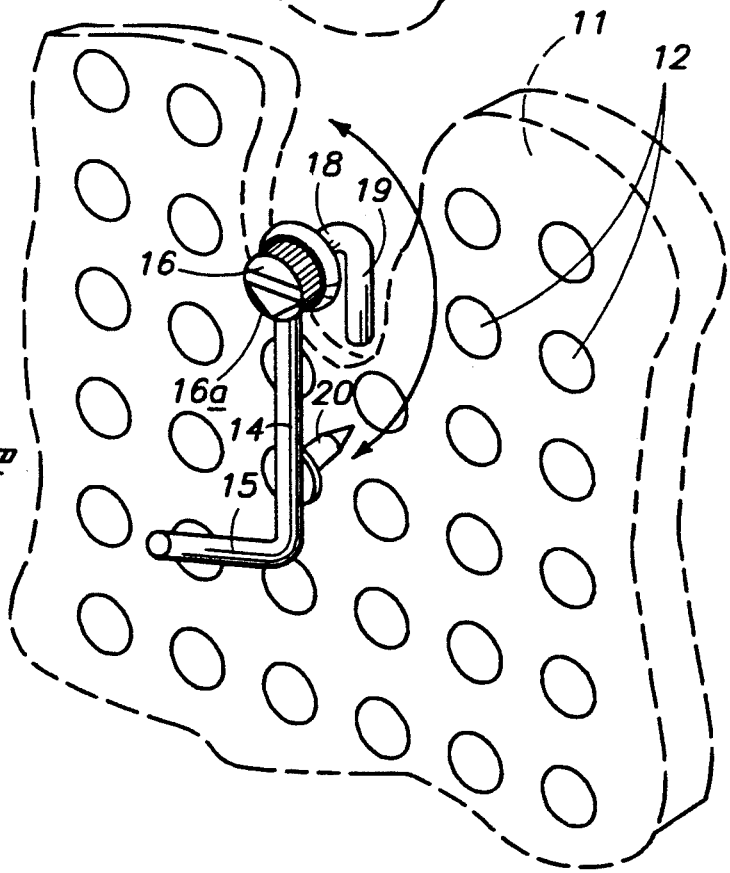
FIG. 2 is an isometric illustration of the invention in a latched configuration relative to the associated peg board.
Figure 3:
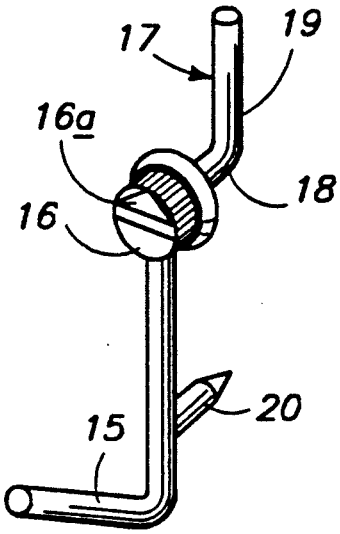
FIG. 3 is an isometric illustration of the instant invention.
Figure 4:
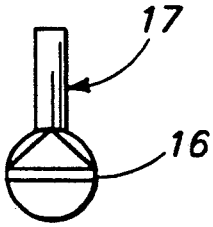
FIG. 4 is an orthographic front view of the lock member utilized by the invention.
Figure 5:
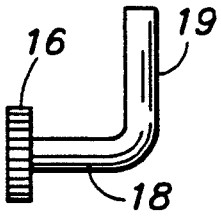
FIG. 5 is an orthographic side view of the lock member.

With reference now to the drawings, and in particular to FIGS. 1 to 14 thereof, a new and improved self-locking peg board hook embodying the principles and concepts of the present invention and generally designated by the reference numerals 10 and 10*a* will be described.

Figure 6:
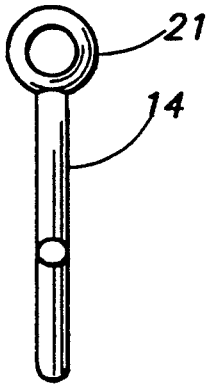
FIG. 6 is an orthographic front view of the hook member utilized by the invention.
Figure 7:
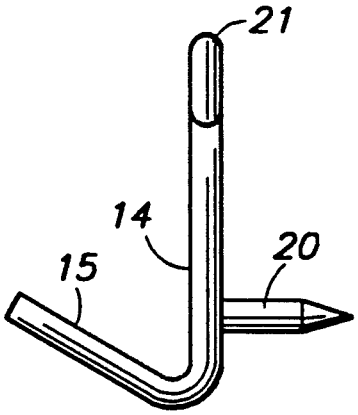
FIG. 7 is an orthographic side view of the hook member.

More specifically, the self-locking peg board hook 10 of the instant invention essentially comprises mounting of the hook structure to an associated peg board 11 that includes a matrix of rows and columns of spaced apertures 12. The hook structure includes a peg board hook 13 defined by a central body leg 14 including a hook projection 15 extending forwardly of the central body leg defining an acute included angle between the central body leg 14 and the hook projection 15 integrally mounted to a lower terminal end of the central body leg 14. A lock leg 17 is rotatably mounted to an upper terminal end of the central body leg 14 to include a rotation head 16, with the rotation head including a rotation head indicator arrow 16*a*, with the indicator arrow 16*a* oriented to indicate the orientation of a lock second leg 19 mounted orthogonally to an outer distal end of a lock first leg 18. The lock first leg 18 is coaxially and integrally mounted to the rotation head 16 extending rearwardly thereof. Further, an alignment leg 20 is mounted orthogonally and integrally to the central body leg 14 between the upper and lower terminal ends thereof and arranged parallel to and below the lock first leg 18. In use, the peg board hook 13 is mounted to the associated peg board 11 by projection of the alignment leg 20 into a rearwardly oriented aperture 12, with the lock first leg and second leg 18 and 19 respectively directed through a further aperture of the peg board, and upon rotation of the rotation head 16, the lock second leg 19 is directed from a first position extending above the central body leg to a second position arranged rearwardly of and extending downwardly relative to the lock first leg to latch the peg board hook 13 to the associated peg board 11. The FIGS. 6 and 7 illustrate the use of a central body leg torroidal head 21 integrally mounted to the upper terminal end of the central body leg 14 to receive rotatably the lock leg 17.

Figure 8:
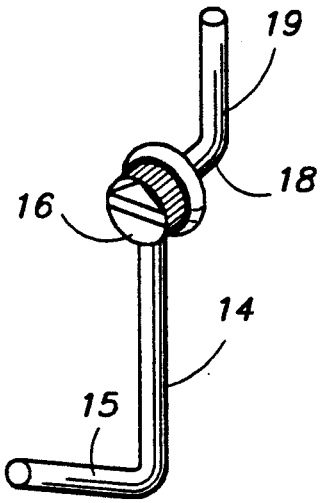
FIG. 8 is an isometric illustration of the invention with the alignment leg absent therefrom.
Figure 9:
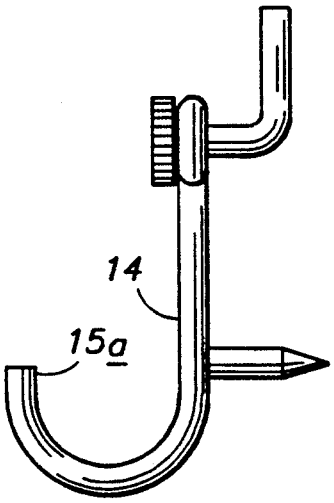
FIG. 9, FIG. 10, FIG. 11, and FIG. 12 are each orthographic side views of modified hook leg structures mounted to the central body leg of the invention in alternative configuration.
Figure 10:
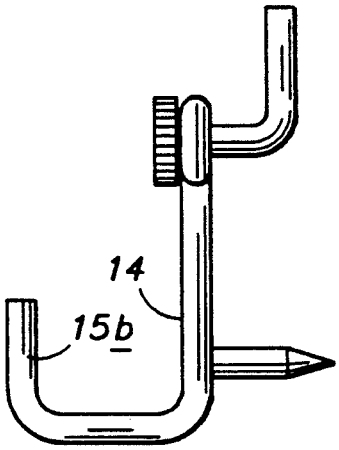
Figure 11:
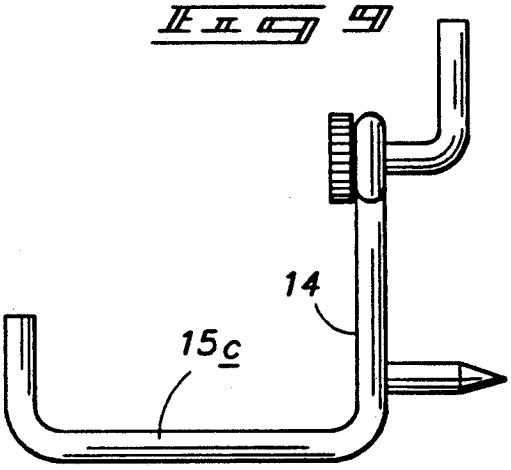
Figure 12:
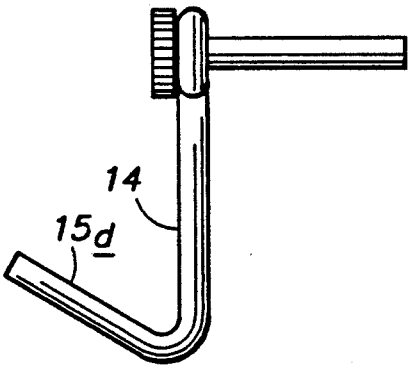

FIG. 8 illustrates the hook structure in the absence of the alignment leg 20, wherein the hook structures 15*a*, 15*b*, 15*c*, and 15*d* respectively define a respective arcuate projection 15*a*, a "U" shaped hook projection 15*b*, an elongate "U" shaped hook 15*c*, and an elongate hook leg 15*b* illustrating alternative hook structures that may be utilized and contemplated by the instance invention.

The FIGS. 13 and 14 illustrate a modified apparatus 10*a*, wherein the peg board hook 13 in association with the peg board 11 includes an "S" shaped contact leg 23 positioned forwardly and above the peg board hook 13. The contact leg 23 includes a contract leg central body 24, with a top leg 25 extending above the lock leg 17 and a contact leg bottom leg 26 extending forwardly of the central body 24 to define a switch gap 27 positioned between a free distal end of the bottom leg 26 and the forward terminal end of the hook leg 15. The switch gap 27 defines an electrical contact switch in operative and electrical communication with an audible alarm unit 22. A battery 28 is mounted within the alarm unit 22, whereupon a metallic tool typically utilized with such hook structures when directed from the hook projection 15 through the switch gap 27 effects electrical communication between the bottom leg 26 and the hook projection 15 to complete an associated circuit and effect momentary actuation of the audible alarm. It should be further noted that the audible alarm may be utilized to provide for a larger time frame for the alarm being actuated to indicate removal of an associated tool from the peg hook 13.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to included variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the forgoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as being new and desired to be protected by Letters Patent of the United States is as follows:

1. A self-locking peg board hook for use in combination with a peg board, the peg board including a matrix apertures, the apertures including at least a first aperture spaced from a second aperture, the peg board hook comprising, a central body leg, the central body leg including a body leg upper terminal end and a body leg lower terminal end, the body leg lower terminal end including a hook projection extending forwardly of the central body leg integrally and fixedly mounted to the body leg lower terminal end defining an acute included angle between the hook projection and the central body leg, and the body leg including lock means rotatably mounted to the body leg upper terminal end, with the lock means directed through the second aperture spaced above the first aperture, and wherein the central body leg includes an alignment leg integrally and orthogonally mounted to the central body leg extending rearwardly of the central body leg and directed through the first aperture, wherein the hook projection extends forwardly of the central body leg and the alignment leg extends rearwardly of the central body leg, and wherein the hook means includes a torroidal head fixed mounted to the central body leg upper terminal end, with the torroidal head rotatably receiving a lock first leg therethrough, the lock first leg is oriented orthogonally relative to the central body leg and arranged parallel to the alignment leg, the lock first leg including a second leg fixedly and orthogonally mounted to a rear distal end of the lock first leg, with the lock first leg directed through the second aperture, and a rotation head fixedly and coaxially mounted to the first leg at a forward end of the lock first leg, and the second leg is arranged parallel to the central body leg, and wherein the second leg is rotated from a first position projecting above the central body leg upper terminal end to a second position extending downwardly of the central body leg upper terminal end, and the rotation head includes an indicator arrow, wherein the indicator arrow is aligned with the second leg, and including an "S" shaped contact leg positioned forwardly and above the central body leg, with the "S" shaped contact leg including a top leg positioned above the first leg, with a bottom leg extending forwardly of the central body leg and terminating in a spaced relationship relative to the hook projection, wherein the bottom leg defines a switch gap between a forward distal end of the bottom leg and a free terminal end of the hook projection, and alarm means in electrical communication with the switch gap, whereupon electrical communication between the bottom leg and the hook projection effects actuation of the audible alarm.

2. A peg board hook as set forth in claim 1 wherein the audible alarm is in electrical communication with the contact leg top leg and in electrical communication with the hook projection, whereupon electrical communication between the hook projection and the contract leg completes an electrical circuit to effect actuation of the audible alarm.

* * * * *